US007644839B2

(12) United States Patent
McNulty, Jr.

(10) Patent No.: US 7,644,839 B2
(45) Date of Patent: Jan. 12, 2010

(54) HOUSING FOR CHEMICAL IRRITANT DISPENSER

(76) Inventor: James F. McNulty, Jr., 1290 Third St., Calimesa, CA (US) 92320

( * ) Notice: Subject to any disclaimer, the term of this patent is extended or adjusted under 35 U.S.C. 154(b) by 214 days.

(21) Appl. No.: 11/053,764

(22) Filed: Feb. 8, 2005

(65) Prior Publication Data

US 2006/0175347 A1 Aug. 10, 2006

(51) Int. Cl.
*A63H 3/18* (2006.01)

(52) U.S. Cl. ..... 222/79; 222/162; 222/182; 222/183; 222/325; 222/402.15; 222/402.21; 42/1.08

(58) Field of Classification Search ..... 222/78–79, 222/325, 162, 164, 182–183, 192, 402.1, 222/402.15, 50, 402.23, 402.21; 42/1.08, 42/1.09, 1.13, 1.15, 1.11
See application file for complete search history.

(56) References Cited

U.S. PATENT DOCUMENTS 3,298,125 A * 1/1967 Adrian et al. ..... 42/1.08
3,385,601 A 5/1968 Black
3,734,353 A 5/1973 McIlhenny
3,841,526 A * 10/1974 Haskins ..... 222/79
4,402,430 A * 9/1983 Fox et al. ..... 222/183
5,255,823 A 10/1993 Tichy et al.
5,310,086 A 5/1994 Julinot
5,458,263 A 10/1995 Ciammitti et al.
5,509,581 A 4/1996 Parsons
5,556,003 A 9/1996 Johnson et al.
5,570,817 A 11/1996 Anderson et al.
5,671,559 A 9/1997 Ludaesher et al.
5,673,436 A 10/1997 Piper
5,673,819 A 10/1997 Brunswig
5,787,628 A 8/1998 Teetzel
5,829,643 A 11/1998 Isabella
5,842,602 A 12/1998 Pierpoint
5,859,588 A 1/1999 Malone et al.
5,865,348 A 2/1999 Harding
5,983,548 A 11/1999 Ludaescher
6,546,661 B1 * 4/2003 Staubs ..... 42/1.08

* cited by examiner

*Primary Examiner*—Frederick C. Nicolas
(74) *Attorney, Agent, or Firm*—Ishman Law Firm P.C.

(57) ABSTRACT

A housing can be mounted to a pistol or other weapon and conveniently fired therefrom and can be used as a discrete weapon itself. A cap has a central aperture which secures the nozzle and/or valve stem of a canister of chemical irritant from movement and is secured to the proximal end of a hollow tube. A feature of the new invention is a slot access running along the length of the tube for some distance from its distal end. The tube may be either open or closed at its distal end. Toward the distal end of the tube, an interior ridge or stop cooperates with the cap aperture to secure the canister of irritant. When a canister is installed in the housing, the operator can release an irritant spray axially from the canister by pressing a digit against the side of the canister's storage cylinder and, thereby, displace its longitudinal axis along an arc. The housing need have no other mechanisms, except the housing and canister. This method also allows for convenient triggering of a spray from a canister within the housing when the housing is secured under or adjacent to the barrel of a handgun. In some embodiments an actuator compresses against a spring-loaded pusher to contact the side of the storage cylinder and move the longitudinal axis of the storage cylinder to release a spray.

14 Claims, 5 Drawing Sheets

HOUSING FOR CHEMICAL IRRITANT DISPENSER

BACKGROUND OF THE INVENITON

1. Field of the Invention

The present invention relates to the field of non-lethal weapons which may be attached to another weapon such as a sidearm. The invention herein relates more particularly to a housing for a canister of chemical irritant spray.

2. Background Art

Handheld canisters, which release chemical irritants, like CS, CN (Chloroacetophenone) and OC (Oleoresin Capsicum) sprays have existed for some time. The canisters comprise a storage cylinder which contains a reservoir of irritant under pressure, a sealing valve and a valve stem, and sometimes a nozzle for directing the spray either radially or axially from the valve opening. When an operator's thumb thrusts the canister's valve stem (or its nozzle, if the nozzle either contacts or can be made to contact the valve stem) downward towards the storage cylinder (compresses the valve) and/or when an operator's thumb forces the longitudinal axis of the valve stem (or its nozzle, if the nozzle either contacts or can be made to contact the valve stem) to travel along an arc (tilts or pivots the valve), the handheld canister will release a spray of irritant.

Over the years, a plethora of housings have been developed to contain such canisters. Some are simply safety caps or housings conceived to prevent accidental movement of the canister's release valve. U.S. Pat. No. 3,734,353 to McIlhenny (1973), U.S. Pat. No. 5,255,823 to Tichy, et al (1993), U.S. Pat. No. 5,310,086 to Julinot (1994) and U.S. Pat. No. 5,458,263 to Ciammitti et al (1995) disclose such safety caps or housings. Other housings also include sometimes elaborate mechanical or electromechanical means for manipulating a canister to release a spray from its reservoir. These housings allow an operator to manipulate a canister to release its spray in one of two basic ways.

The thumb or a digit of the operator's hand and/or mechanism surface may tilt or compress the canister's valve stem. U.S. Pat. No. 3,385,601 to Black (1968) discloses a housing mechanism which forces a canister's valve stem to travel along an arc (tilt) to release a spray of irritant. As illustrated therein, aftward movement of trigger 62, 64 causes the longitudinal axis of valve stem 70 to travel along an arc and release a spray of irritant from storage cylinder 66. In U.S. Pat. No. 5,556,003 to Johnson, et al (1996), an operator's thumb compresses button 62 and, thereby valve stem 68 toward storage cylinder 41 to release an irritant spray radially through release valve 44, over valve stem 68 and through a directing nozzle. In U.S. Pat. No. 5,829,643 to Isabella (1988) (FIGS. 5-7), trigger button 105 is compressed axially toward storage cylinder 103 to release a spray radially through directing nozzle 104.

Alternatively, a mechanism surface may cause the storage cylinder to travel axially and compress against its valve or nozzle, which is secured from movement by the housing or becomes secured from movement by the housing. The secured nozzles allow for more precise aiming of the spray. In U.S. Pat. No. 5,509,581 to Parsons (1996) (FIG. 3), stem 16 advances canister 64 axially against spring 46 forcing nozzle 66 into canister 64 to release a spray of irritant axially. In U.S. Pat. No. 5,842,602 to Pierpoint (1998), nozzle 26 is cemented into housing 29. Activation of a solenoid forces canister 25 within housing 29 to move toward dispensing end 21 to compress nozzle 26 toward canister 25. Longitudinal compression of nozzle 26 toward canister 25 dispenses irritant 36 axially. In U.S. Pat. No. 5,570,817 to Anderson et al (1996) (FIGS. 4-6), thumb pressure on actuator button 32 causes canister 26 to travel axially until its valve stem impacts valve stem receiver 24 and is compressed to release a spray of irritant radially through an integral nozzle.

As also seen above, over the years, these housings have been disguised, contained within or combined with various other devices and weapons, including small arms. In U.S. Pat. No. 5,673,436 to Piper (1997), an electrically operated valve releases an irritant spray axially from a canister concealed within a glove. U.S. Pat. No. 5,859,588 to Malone, et al (1999) is for mechanisms which can release upon an attacker a spray from a canister of irritant while the canister remains concealed within a purse. U.S. Pat. No. 5,865,348 to Harding (1999) is for mechanisms which can release upon an attacker a spray from a canister of irritant while the canister remains concealed within a dumbbell. U.S. Pat. No. 5,673,819 to Brunswig (1997) is for mechanisms which can release upon an attacker a spray from a canister of irritant while the canister remains concealed in a pager, flashlight or handgun. The Brunswig patent also illustrates all of the basic types of release mechanisms described heretofore and below.

Canisters, which release their sprays axially through secured nozzles by displacements of their storage cylinders, are better suited for mounting on side arms. However, the housing mechanisms that actuate a canister to release a spray of chemical irritant, are subject to failure generally and difficult to actuate when mounted on side arms. Even more complicated and expensive mechanism assemblages must be combined with the existing actuators so the canisters can be conveniently triggered to release a spray while mounted on firearms, like pistols, as illustrated in U.S. Pat. No. 5,787,628 to Teetzel (1998) (releases spray vial electromechanical mechanism), U.S. Pat. No. 5,671,559 to Ludaesher, et al (1997) (a plunger displaces the storage cylinder axially against a spring and, thereby, compresses the canister valve stem toward the cylinder to release a spray axially) and U.S. Pat. No. 5,983,548 to Ludaescher (1999) (FIG. 2) (arm 22 rotates to move actuator plate 38 to displace storage cylinder 20, which is restricted (friction fit) within tube 18, axially into actuator ridge 24 to open canister valve 25 to release a spray of irritant axially. The present invention resolves all of these problems through a unique combination of features, which now allows a shooter to release the spray without removing his or her firing or supporting hand from its firing or supporting position on the attached handgun.

SUMMARY OF THE INVENITON

The invention comprises a novel canister housing which can be mounted to a pistol or other weapon and conveniently fired therefrom and which can also be used as a discrete weapon itself. The invention consists of a cap, which has a central aperture which secures the nozzle and/or valve stem of a canister of chemical irritant from movement and which can, itself, be secured to the proximal end of a hollow tube. This is a prior art feature that allows for more accurate aiming of the chemical spray. A feature of the new invention is a slot access running along the length of the tube for some distance from its distal end. The tube may be either open or closed at its distal end. Toward the distal end of the tube, there may exist an interior ridge or stop, which cooperates with the cap aperture to secure the canister of irritant. When a canister of chemical irritant is installed in the housing, the operator can manually release a spray of irritant from the canister by pressing a digit of one of his hands against the side of canister's storage cylinder and, thereby, displace its longitudinal axis along an arc. For this unique method of releasing the spray axially from its canister, the housing need have no moving parts or triggers or other mechanisms, except the housing and canister themselves. This unique method also allows for the convenient triggering of a release of a spray from a canister of irritant within the housing when the housing is secured under or adjacent to the barrel of a handgun. A door may cover the slot and in some embodiments an actuator compresses against a spring-loaded pusher to contact the side of the canister or storage cylinder and move the longitudinal axis of the canister or storage cylinder to release a spray.

In the preferred embodiments, the tube is a hollow cylinder. In one embodiment, the tube is a hollow cylinder, and the cap is thread connected to the tube. In a second embodiment, the tube is also a hollow cylinder, but a catch and ridge structure secures the cap to the housing. In each embodiment, the tube may have a slot which begins at its distal end and extends along the tube. At the proximal end of the tube a plurality of catches and one ridge, which are all of equal width and which are placed equidistantly around the tube, secure the tube to the cap. The tube exterior has a ridge circumferentially around the proximal end for receiving each catch. The catches can now be alternatively seated to allow convenient right, left or center triggering of a handgun mounted canister and housing combination. Each embodiment is shown with hardware for mounting the housing to a gun rail. In both embodiments, the tube has an interior recess or slot to reduce the likelihood of inadvertent impact discharges from the canister. In another illustrative embodiment, the tube is a rectangular housing which is secured to a rectangular cap by two tongue and groove catches. In each embodiment, the slot may travel a short distance up the tube length or along the entire length of the tube.

A small canister of irritant containing 4.5 grams of law enforcement strength nonflammable pepper spray with a heat rating off 2 million SHU, such as sold by Spitfire, Ltd., 8868 Research Boulevard, No. 203, Austin, Tex. 78758, is placed or replaced into the housing. These canisters can release adequate sprays of debilitating irritant in a cone pattern to a distance of about 8 feet.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF PREFERRED EMBODIMENTS

Referring to the accompanying drawings and to FIGS. 1-4 in particular, it will be seen that a weapon and housing assembly 10 of the present invention comprises a dispenser housing 12 attached to a weapon 20. Weapon 20 is shown only for purposes of illustrating how the housing 12 may be attached to the rail of another weapon which may be of the lethal or non-lethal type.

Figure 9:
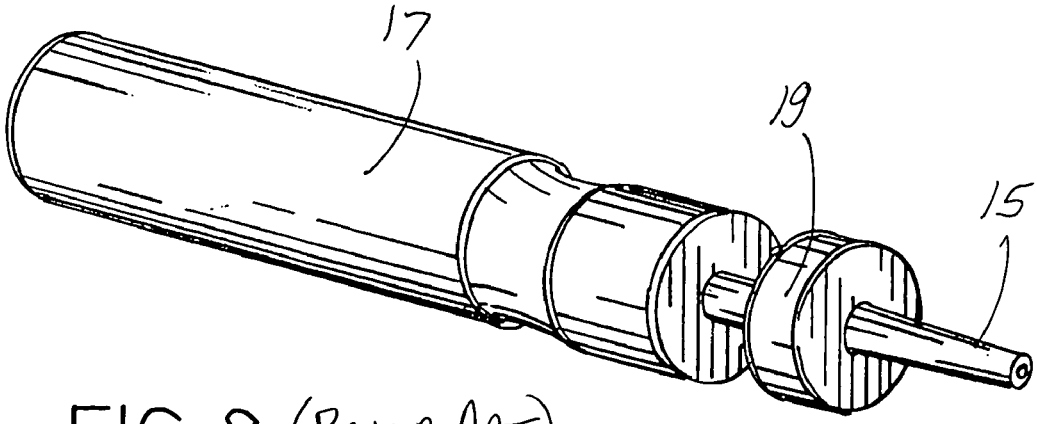
FIG. 9 (PRIOR ART)
FIG. 9 is a three-dimensional view of a conventional canister.

Housing 12 comprises a hollow cylindrical tube 14 with an open end enclosed by a removable cap 16, the latter having an axial aperture 13 through which the nozzle 15 of a conventional canister 17 (see FIG. 9) protrudes. As shown best in FIGS. 2 and 3, tube 14 is affixed to a rail 22 of weapon 20 by a yoke 18, a rail attachment 24 and a clamp 26, using a bolt 25 and a pair of screws 28.

Figure 1:
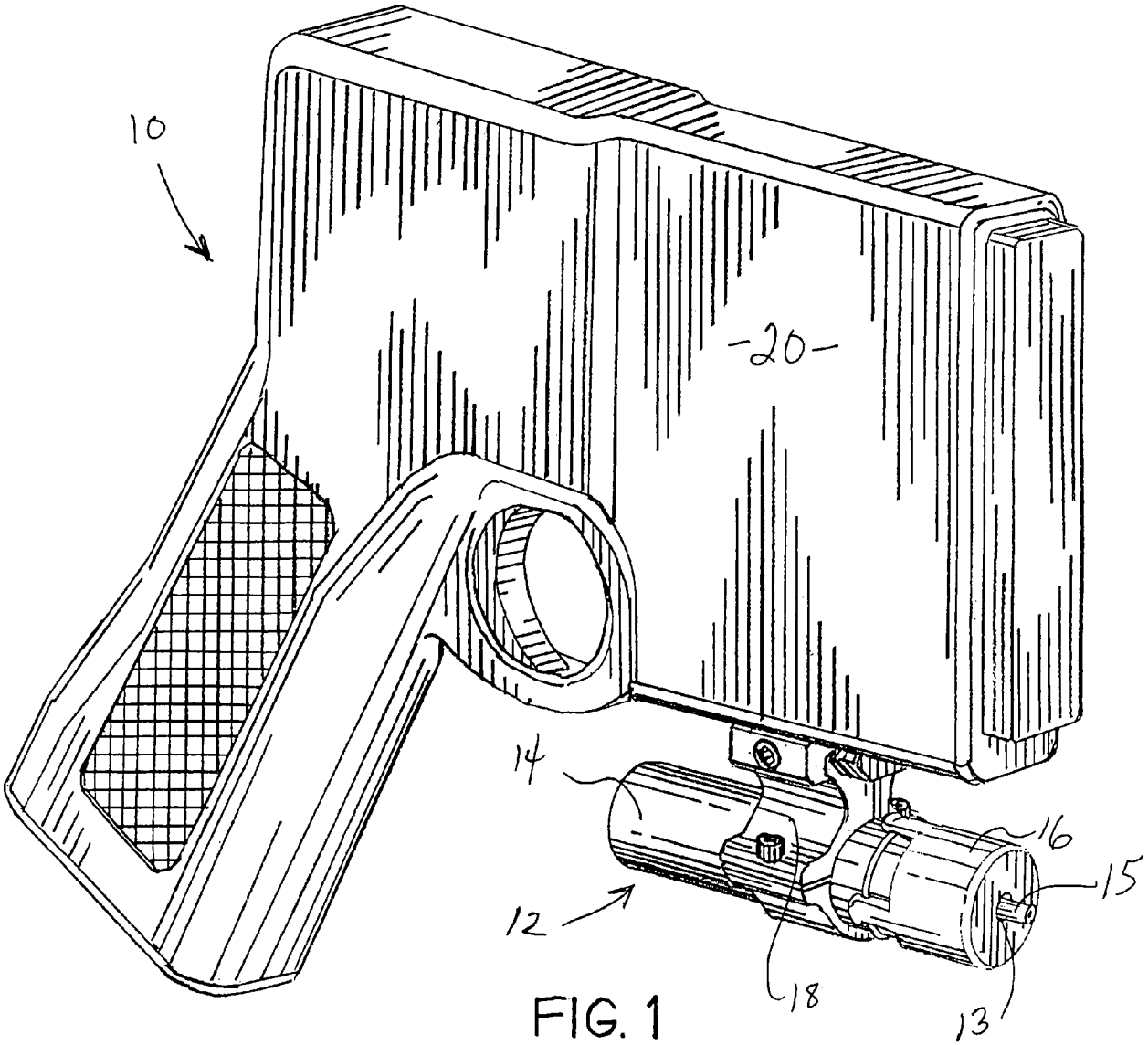
FIG. 1 is a three-dimensional drawing of a first embodiment of a dispenser housing shown attached by a rail mechanism to a pistol-shaped weapon.
Figure 2:
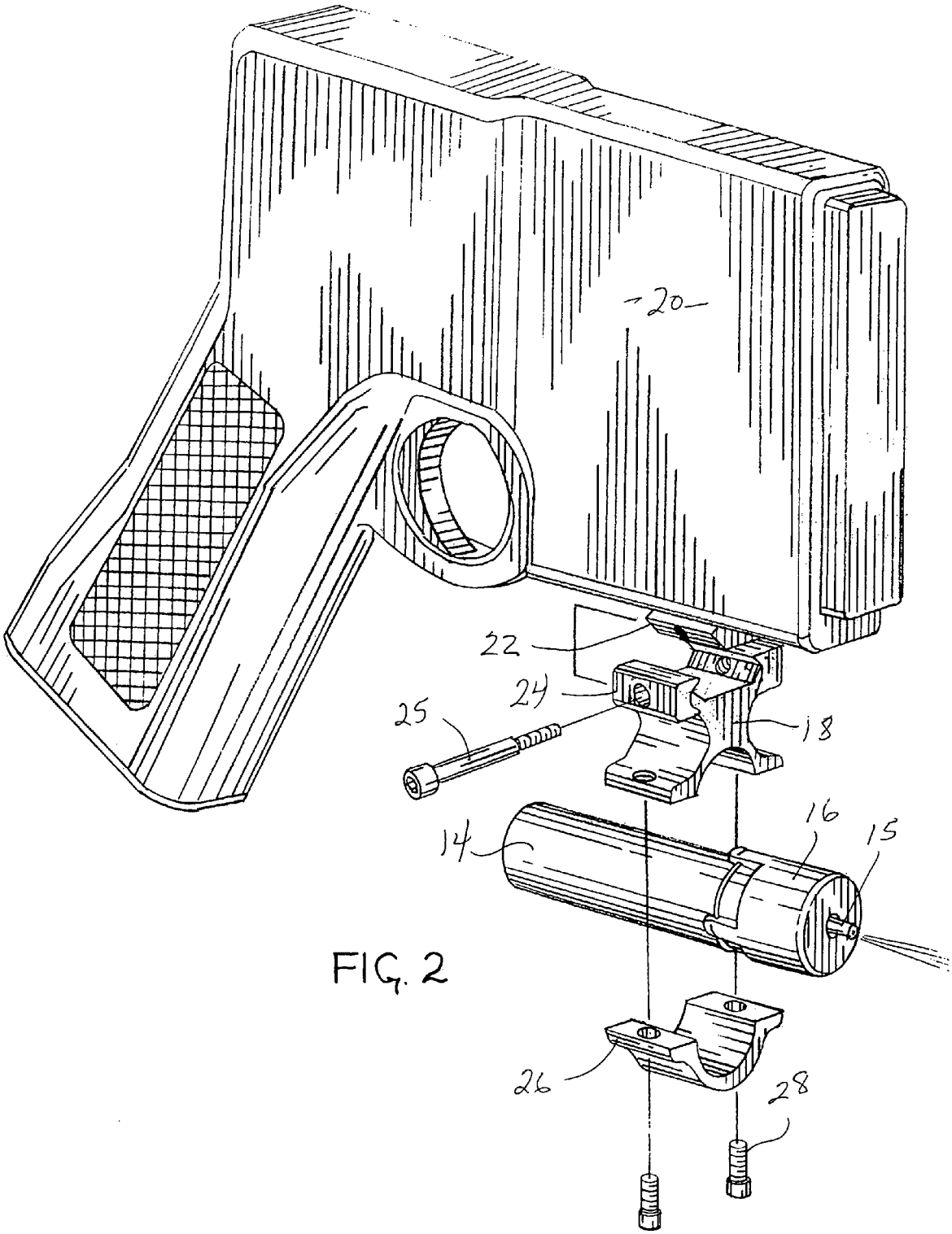
FIG. 2 is a view similar to FIG. 1 but showing the rail mechanism in exploded view.
Figure 4:
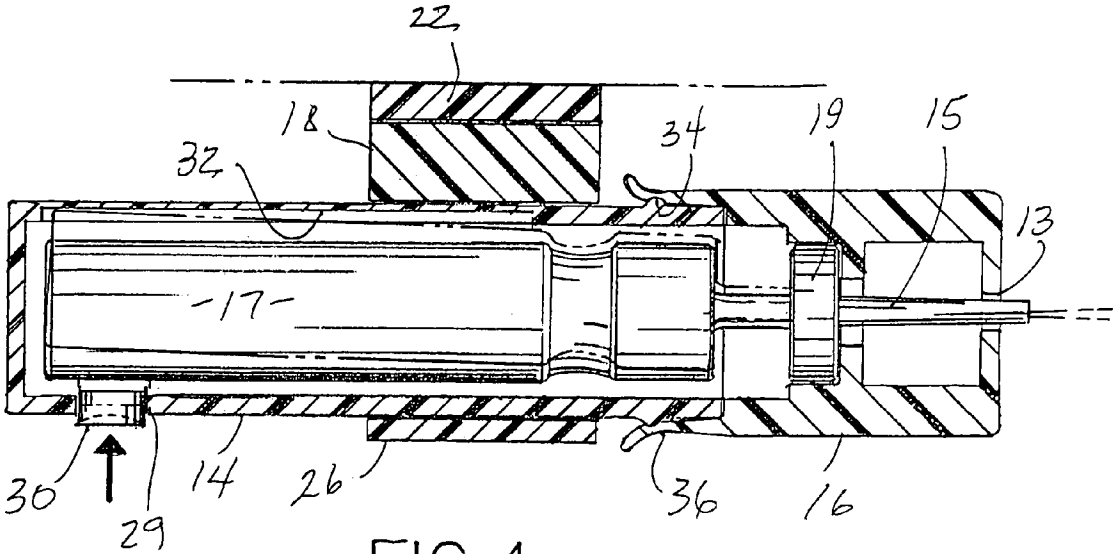
FIG. 4 is a cross-sectional view of the housing of FIG. 1 taken along lines 4-4 of FIG. 3.

As shown in FIG. 4, the canister resides within tube 14 and cap 16 with its nozzle 15 extending through aperture 13 and with its nozzle base 19 firmly secured so that the nozzle remains fixed axially. Cap 16 is releasibly secured to tube 14 by a plurality of equally spaced catches 36 extending from the cap and engaging an annular ridge 34 around the proximal end of the tube for a snap fit attachment thereto.

At the distal end of tube 14 there is a radial aperture 29 in which is positioned a spring-loaded actuator 30. When depressed by a finger, actuator 30 bears against the radial surface of canister 17 displacing it transversely to its axis and into an internal recess 32 in the interior of tube 14. When sufficiently displaced, the misalignment of canister 17 from fixed nozzle 15 opens a valve at the proximal end of canister 17 allowing the pressurized irritant content to be released as a spray through nozzle 15 toward a remote target.

Figure 5:
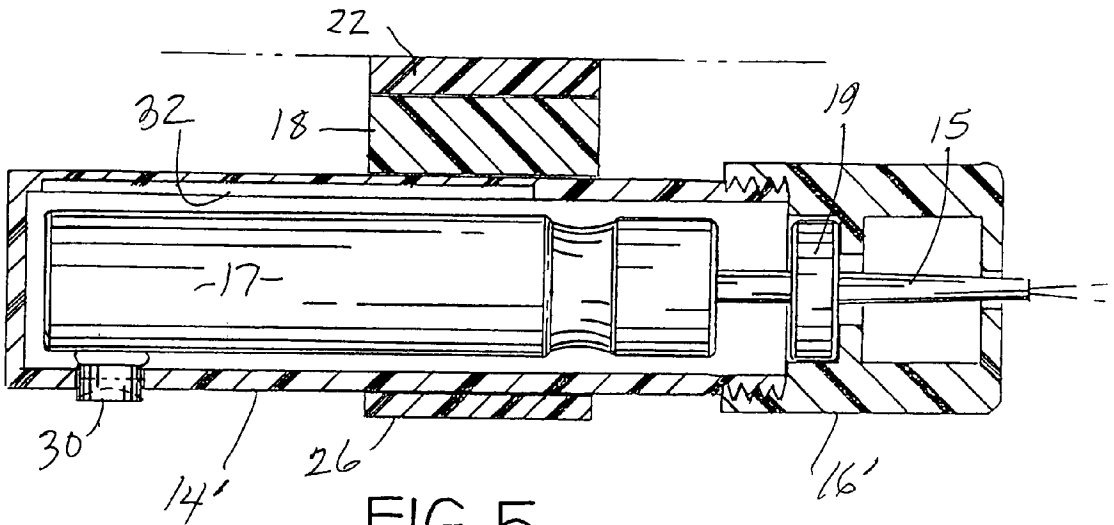
FIG. 5 is a cross-sectional view similar to that of FIG. 4 but showing a second embodiment of the housing.
Figure 3:
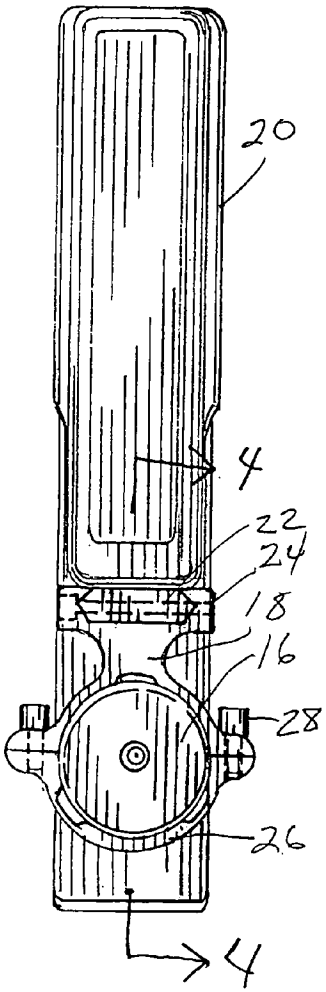
FIG. 3 is an end view of the housing of FIG. 1.

FIG. 5 illustrates a second embodiment using a tube 14' and a cap 16' which have mutually threaded ends for threading engagement of the tube and cap.

Figure 6:
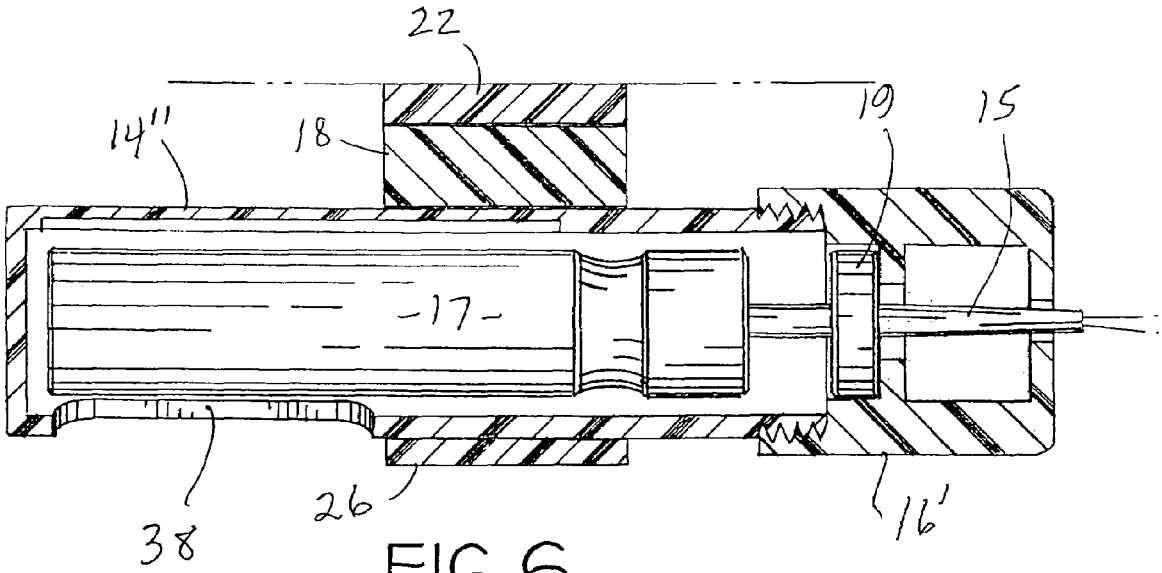
FIG. 6 is a cross-sectional view similar to that of FIG. 5 but showing a third embodiment of the housing.
Figure 7:
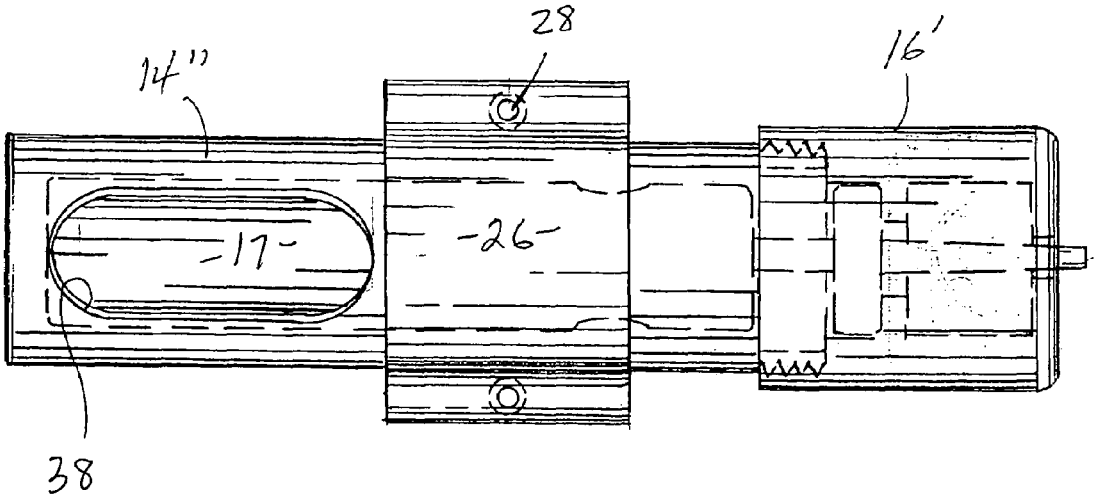
FIG. 7 is a bottom view of the housing of FIG. 6.

FIGS. 6 and 7 illustrate a third embodiment wherein tube 14' of FIG. 5 is replaced by a tube 14" which uses an elongated slotted opening 38 instead of activator 30 of FIG. 5. Opening 38 permits direct contact with canister 17 so that it can be directly displaced by the force of a finger through the opening for releasing the irritant spray through nozzle 15.

Figure 8:
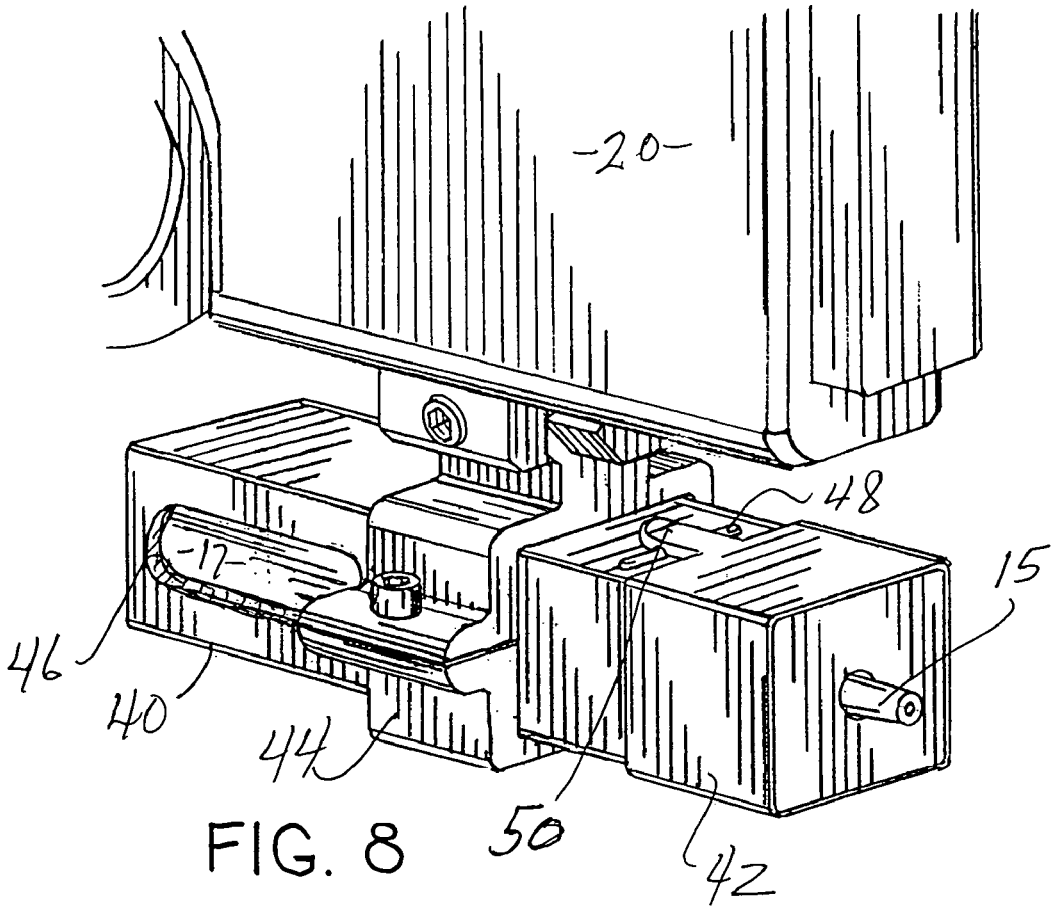
FIG. 8 is a three-dimensional view of still another embodiment of the inventive housing.

FIG. 8 illustrates yet another embodiment of the inventive housing hereof wherein a rectangular tube 40 cooperates with a rectangular cap 42 and is attached to weapon 20 by a suitably altered rail attachment assembly 44. A side oriented elongated slot 46 provides access to displace canister 17 to release a spray of irritant through nozzle 15. Cap 42 is snap-fit attached to tube 40 using a pair of ridges 48 and a catch 50 extended from opposed surfaces of the cap.

Having thus disclosed preferred embodiments of the invention, it will now be apparent that various modifications may be made without deviating from the inventive concepts disclosed herein. By way of example, the precise shape and dimensions of the housing may be readily altered as well as the manner with which it is attached to a weapon. Moreover, the housing may be fabricated as a unitary member in which the tube and the cap are integrated into a single unit. Accordingly, the scope hereof is to be limited only by the appended claims and their equivalents.

I claim:

1. A housing apparatus for positioning an irritant dispenser canister on a rail of a hand-held weapon for spraying the irritant through an axial nozzle at an assailant; the housing comprising:

an elongated hollow tube coaxially receiving said canister;

a cap releasably attached to said tube by at least one catch engaging a ridge and having an axial aperture for fixing said nozzle for firing said irritant spray in a selected direction; and a structure for securing said tube to said rail;

said tube providing access to a radial surface of said canister for tilting said canister relative to said nozzle for releasing said irritant.

2. The housing recited in claim 1 wherein said access comprises a pushable actuator in a radial wall of said tube.

3. The housing recited in claim 1 wherein said access comprises an opening in a radial wall of said tube.

4. The housing recited in claim 1 wherein said cap is attached to said tube by mutual thread engagement.

5. The housing recited in claim 1 wherein said tube comprises an interior surface having a recess for enabling displacement of said canister relative to said nozzle.

6. The housing recited in claim 1 wherein said tube and said cap are configured as a circular cylinder.

7. The housing recited in claim 1 wherein said tube and said cap have non-circular cross sections.

8. A housing apparatus for containing an irritant dispenser canister for spraying the irritant through an axial nozzle at an assailant, the housing comprising:

an elongated hollow tube coaxially receiving said canister;

a cap releasably attached to said tube by at least one catch engaging a rib and having an axial aperture for fixing said nozzle for firing said irritant spray in a selected direction; and said tub providing access to a radial surface of said canister for tilting said canister relative to said nozzle for releasing said irritant.

9. The housing recited in claim 8 wherein said access comprises a pushable actuator in a radial wall of said tube.

10. The housing recited in claim 8 wherein said access comprises an opening in a radial wall of said tube.

11. The housing recited in claim 8 wherein said cap is attached to said tube by mutual threaded engagement.

12. The housing recited in claim 8 wherein said tube comprises an interior surface having a recess for enabling displacement of said canister relative to said nozzle.

13. The housing recited in claim 8 wherein said tube and said cap are configured as a circular cylinder.

14. The housing recited in claim 8 wherein said tube and said cap have non-circular cross-sections.

* * * * *